United States Patent [19]

Callihan et al.

[11] 4,436,151

[45] Mar. 13, 1984

[54] APPARATUS FOR WELL CEMENTING THROUGH A TUBULAR MEMBER

[75] Inventors: Rudy B. Callihan; Lyndon R. Stone, both of San Antonio, Tex.

[73] Assignee: Baker Oil Tools, Inc., Orange, Calif.

[21] Appl. No.: 385,613

[22] Filed: Jun. 7, 1982

[51] Int. Cl.[3] ..... E21B 33/16; E21B 33/06

[52] U.S. Cl. ..... 166/154; 166/318; 166/317; 166/319

[58] Field of Search ..... 166/153–156, 166/193, 194, 289, 318, 328, 317, 319, 291, 70

[56] References Cited

U.S. PATENT DOCUMENTS

| | | | |
|---|---|---|---|
| 2,435,016 | 1/1948 | Pitts | 166/154 |
| 3,768,556 | 10/1973 | Baker | 166/154 |
| 3,768,563 | 10/1973 | Blount | 166/291 |
| 3,789,926 | 2/1974 | Henley et al. | 166/154 X |
| 3,811,500 | 5/1974 | Morrisett et al. | 166/154 |
| 4,042,014 | 8/1977 | Scott | 166/154 |
| 4,246,968 | 1/1981 | Jessup et al. | 166/318 X |

*Primary Examiner*—Stephen J. Novosad
*Assistant Examiner*—Thuy M. Bui
*Attorney, Agent, or Firm*—Norvell & Associates

[57] ABSTRACT

An apparatus for effecting two stage cementing of well conduits by supplying cement through a smaller diameter tubular member. The apparatus involved provides a tubular assembly attachable to the bottom end of a well conduit. The tubular assembly defines an axial cementing passage through its bottom end. Cementing ports are provided in the tubular assembly above its bottom end to implement the second stage cementing operation. A tubular member is sealingly secured in the upper end of the tubular assembly and valve units are provided between the end of the tubular member and the cementing ports. The lower annular valve unit is selectively releasably positioned in a closed position relative to the radial cement ports. At the conclusion of the first stage of cementing, a first sealing plug is dropped through the tubular member into sealing engagement with the bore of the lower annular valve unit and fluid is applied through the tubular member to shift the lower annular valve unit to an open position. After the second stage, a second sealing plug is dropped through the tubular member to seal the bore of the upper annular valve unit and fluid pressure applied through the tubular member will effect the displacement of the upper annular valve unit to a position sealing the radial cementing ports.

5 Claims, 12 Drawing Figures

APPARATUS FOR WELL CEMENTING THROUGH A TUBULAR MEMBER

BACKGROUND OF THE INVENTION

1. Field of the Invention

The invention relates to the cementing of well conduits in well bores by cement supplied through a substantially smaller diameter tubular member extended concentrically downwardly through the conduit.

2. Description of the Prior Art

The practice of cementing the bottom portions of well casings or conduits in wells is commonplace. When wells were drilled to accommodate moderate size casing diameters in the range of four to seven inches, it was expedient to supply the cement for the cementing operation by pumping the cementing fluid directly through the bore of the installed casing. As casing sizes and well depths have increased, it has become increasingly difficult to utilize the entire casing bore as a conduit for the cementing fluid due to the large quantities of cementing fluid that are required to be transmitted through the casing bore and to the excessively large pressures required to force that large fluid volume of cementing fluid outwardly around the exterior of the casing. Furthermore, the entire casing bore has to be carefully wiped subsequent to the cementing operation and no wiping operation is perfect, thus resulting in patches of cement film being adhered to a large number of regions of the casing bore which would substantially interfere with the deployment and setting of tools normally required to place a well in production.

In recent years, it has been the practice to accomplish the cementing of large diameter well casings by running in a drill pipe or other tubular member to the bottom of the casing or other conduit and supplying the cementing fluid through the smaller diameter drill pipe. The small drill pipe can withstand the higher pressures required to effect the desired distribution of the cementing fluid. Furthermore, after the cementing operation, the drill pipe can be removed and the fact that the bore of the drill pipe is not cleanly wiped is immaterial insofar as the subsequent operations on the well are concerned.

Even with drill pipe application of cement, there is a pracactical limit to the amount of cement that can be caused to flow upwardly around the exterior of the well casing. It therefore becomes desirable to effect the cementing of the well through the drill pipe in at least two stages. In the first stage, the cement is discharged into the well bore through an axial cement conduit formed in the bottom of the casing. In the second stage, cement is discharged through radial ports provided in the well casing at a position above the level of the cement introduced during the first stage operation. The radial cement ports obviously have to be sealed during the first stage cement operation and then resealed at the conclusion of the second stage cement operation.

SUMMARY OF THE INVENTION

The invention provides a method and apparatus for effecting two stage cementing of a large diameter well conduits by cement introduced through a small diameter tubular member. A tubular assembly, constituting in effect an extension of the well conduit, is secured to the bottom end of the conduit and inserted in the well bore with the conduit. The tubular assembly includes an axial cementing conduit in its bottom end which may be provided with a customary cementing shoe to permit entry of well bore fluids, which may include drilling mud, during the insertion of the conduit into the well. The tubular assembly is further provided with a plurality of peripherally spaced radial cementing ports located at a suffificient height above the bottom end of the tubular assembly to implement the second stage cementing operation. At a still higher location, the tubular assembly is provided with a seal bore for sealingly receiving the end of a small diameter tubular member through which cementing fluid is applied.

Between the end of the tubular member and the radial cementing ports, a pair of axially spaced, annular valving units are provided which successively cooperate with the radial cement ports. The first or lower annular valving unit normally maintains the radial cement ports in sealed relationship, but can be shifted downwardly by dropping a sealing plug through the tubular member to seal the bore of the lower annular valve unit and thus effectively close the bore of the tubular extension, permitting fluid pressure therein to be increased to a level that will force the annular valving unit downwardly to open the radial cementing ports. The second stage cementing operation can then be accomplished with cement flowing from the tubular member through the radial passages to the exterior of the assembly and the conduit.

At the conclusion of the second stage cementing operation, a second sealing plug is dropped or pumped through the tubular member to engage an appropriate bore sealing surface on the second or upper annular valving unit which is located above the radial cementing passages. Fluid pressure applied through the tubular member operate on the upper annular valving unit to force it downwardly to close the radial cementing ports, thus completing the cementing operation. If desired, the last sealing plug dropped or pumped through the tubular member may be constructed with wiping flanges to achieve a wiping of the interior of the tubular member so that it may be immediately used for subsequent cementing operations. If it is contemplated that all internal components of the tubular assembly will be drilled out to provide an unrestricted bore, the sealing sleeve of the upper annular sealing unit is disposed on the exterior of the tubular assembly, hence the sealing of the radial cementing ports will not be disturbed by the drill out.

DESCRIPTION OF THE PREFERRED EMBODIMENTS

Figure 1A:
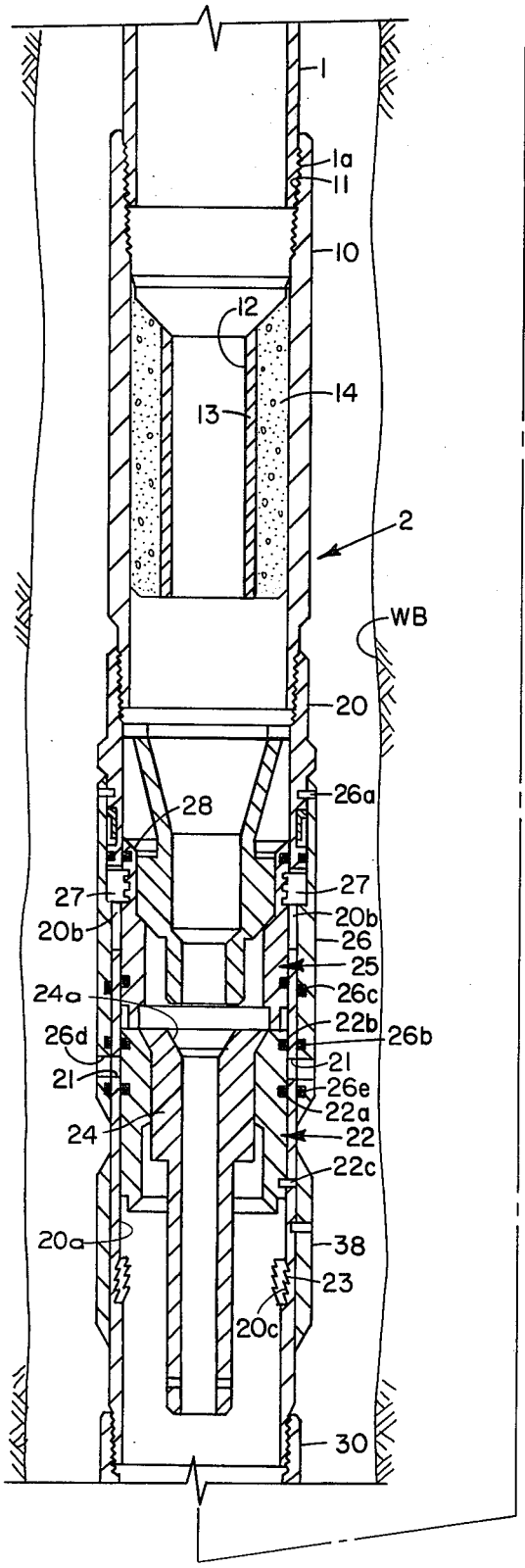
FIGS. 1A and 1B are collectively a vertical sectional view of a two stage, tubular member cementing apparatus embodying this invention, showing the apparatus positioned in a newly drilled well bore at the bottom of a well conduit, FIG. 1B being a vertical continuation of FIG. 1A.

Referring to FIG. 1, a casing or conduit 1 is inserted in a newly drilled well bore WB. On the lower end of casing 1, a tubular assembly 2 incorporating a cementing apparatus embodying this invention is secured by threads 1*a*. The tubular extension in effect constitutes a continuation of the well casing to a desired point above the bottom of the well bore WB. Tubular assembly 2 comprises a threaded assembly of a plurality of sleeve elements 10, 20, 30, 40, 42 and 50, in descending order. Such sleeve elements respectively define a seal bore, a dual sleeve valve assembly, a wiper plug mounting assembly, a connector sleeve, a spacer sleeve and a float valve unit.

The top sleeve element 10 is provided with internal threads 11 for cooperation with the casing threads 1*a* . A seal bore 12 is defined within the top sleeve element 10 through the mounting of a metallic tube 13 within a supporting annulus of cement 14. The interior seal bore 12 is proportioned to be engaged by seals carried by the bottom end of an inserted tubular member or drill pipe of substantially smaller diameter than casing 1, as will be later described.

The second sleeve element 20 is provided with a plurality of peripherally spaced, radial cementing ports 21. A first annular valve unit 22 is mounted within the bore 20*a* of the sleeve element 20 and initially positioned in overlying relationship to the radial cementing ports 21. A pair of annular seals 22*a* and 22*b* are respectively disposed on opposite sides of the radial cementing ports 21 and the annular valve unit 22 is retained in such sealing position by one or more radially disposed shear pins 22*c*. Further details of the valve structure will be later described.

The second sleeve element 20 is further provided with a second or upper annular valve unit 25 which includes a valve sleeve 26 slidably mounted on the exterior of the sleeve element 20 and initially secured by one or more shear pins 26*a* at a position where radial ports 26*d* in sleeve 26 are aligned with the radial cementing ports 21. The outer valve sleeve 26 is provided with an annular seal 26*e* positioned below ports 26*d*, and a pair of annular sealing elements 26*b* and 26*c* which can be respectively positioned above and below the radial cementing ports 21 to close same after the first annular valve element 22 is moved downwardly to open the radial cementing ports.

To actuate the external valve sleeve 26, an internally disposed annular piston assembly 28 is provided which is slidably mounted within the bore of the housing sleeve element 20. Piston element 28 is connected to the outer valve sleeve 26 by a plurality of radially disposed lugs 27 which extend through axially extending slots 20*b* provided in the sleeve element 20 to abuttingly engage the outer valve sleeve 26. Further details of this construction will be later described.

The third housing sleeve element 30 includes an annular wiping plug mount 32 which is selectively disengagably connected to the sleeve element 30 by, for example, one or more shear screws 32*a*. An annular elastomeric wiper plug 34 is bonded to a sleeve 36 which in turn is threadably secured to the mounting plug 32 by threads 35. The elastomeric wiping plug 34 is of conventional configuration and includes a plurality of peripherally extending, radially projecting wiping flanges 34*a* proportioned to effect a wiping of all portions of the bore of the tubular assembly 2 which are disposed below the initial position of the wiper plug.

Elements 40 and 42 constitute conventional connectors and spacers to provide the desired vertical spacing between the radial cementing ports 21 and the lowermost housing sleeve element 50 within which is mounted a conventional float shoe 52.

Float shoe 52 includes a centrally apertured flapper valvehousing 54 disposed in vertically spaced relationship to a ball catcher sleeve 56 which is snugly mounted in a supporting sleeve 58. A ball 51 is disposed in unidirectional sealing engagement at the lower end of the sleeve 56. Upon sufficient increase in fluid pressure within the casing, the ball 51 will engage an annular, shearable retaining flange 57 provided on the ball catching sleeve 56. The continued application of pressure will cause the ball catching sleeve 56 to be moved downwardly within the supporting sleeve 58, thus freeing a spring biased flapper valve 53 to swing into closing engagement with the axial opening in the housing 54. Continued application of fluid pressure will then cause the shearing of the retaining flange 57 on the ball catcher sleeve 56 and permit the ball 51 to be expended outwardly through the bottom end of the tubular housing 2.

If desired, a pivoted, spring biased flapper valve 59 may be conventionally mounted at the bottom end of the float valve apparatus for known purposes, and does not form a part of the invention per se.

The float shoe 52 further provides an upwardly facing, inclined annular sealing surface 52*a* which sealingly cooperates with a correspondingly shaped bottom surface 34*b* formed on the elastomeric plug 34.

Figure 1B:
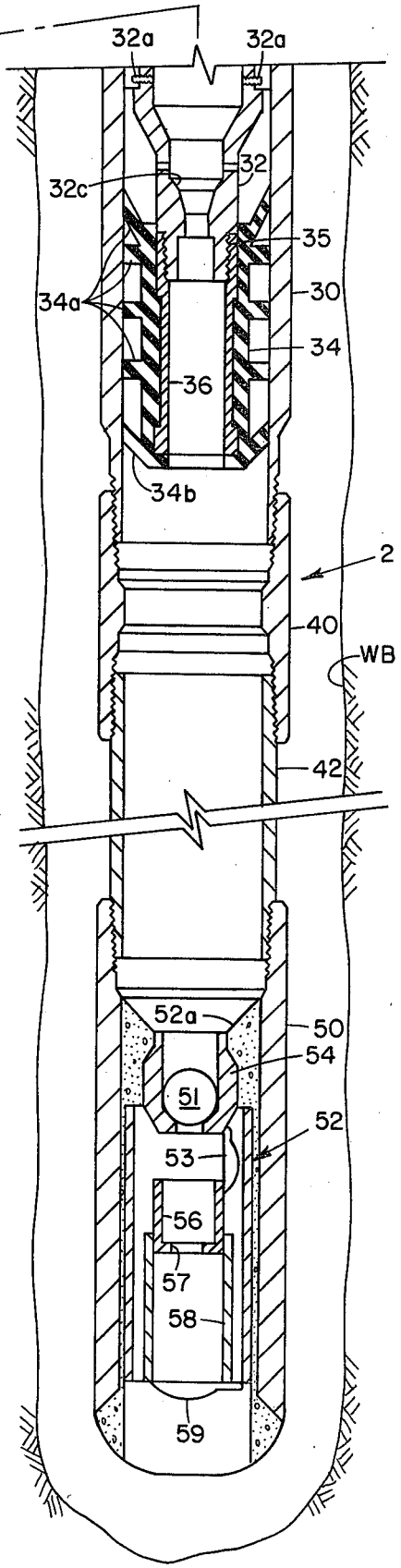
Figure 2A:
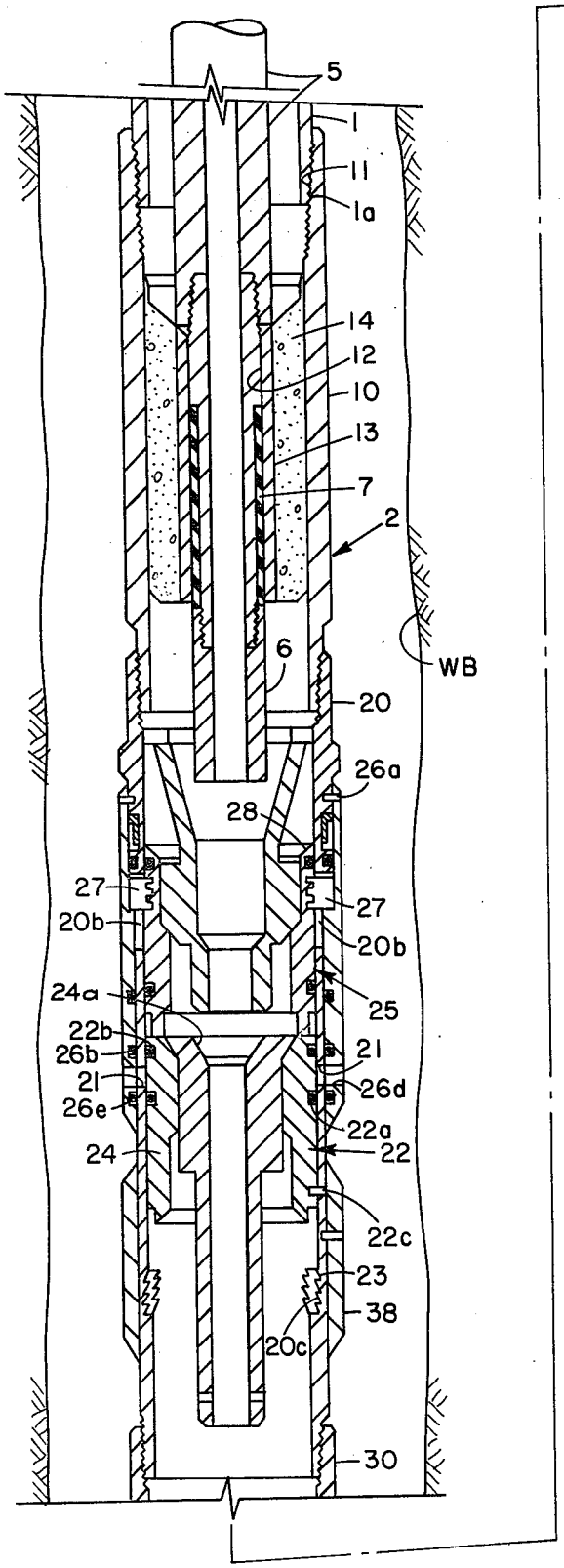
FIGS. 2A and 2B are respectively views similar to FIGS. 1A and 1B but showing the insertion of a tubular member in the tubular assembly of the cementing apparatus.
Figure 2B:
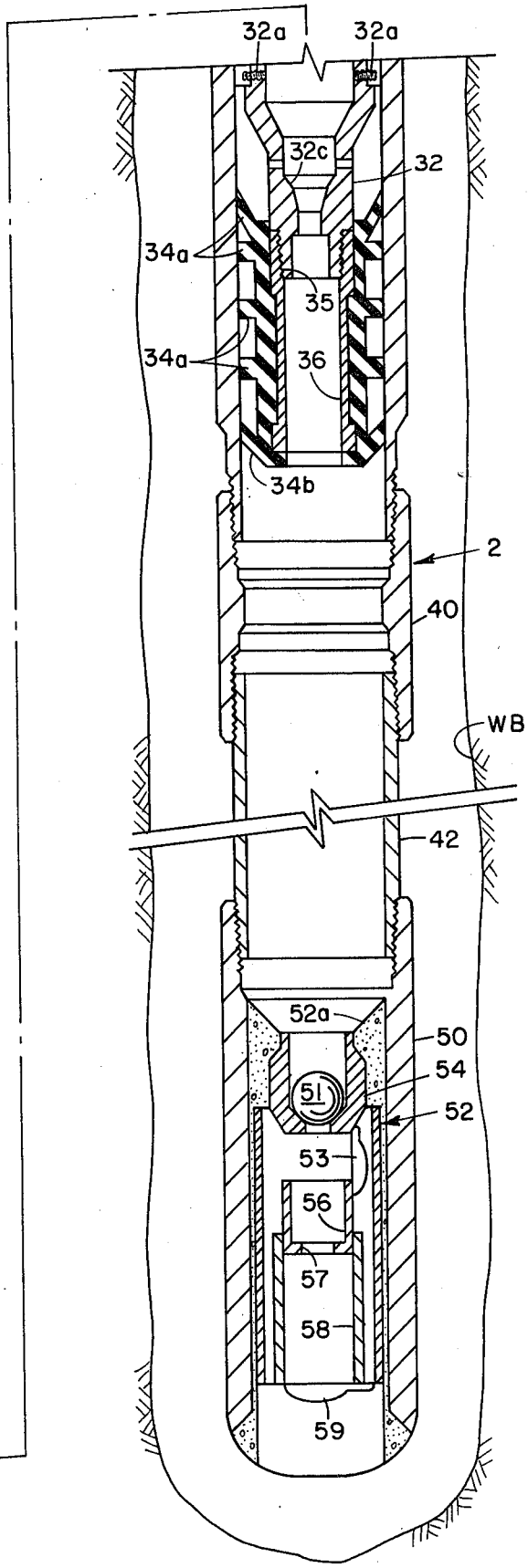
Figure 3A:
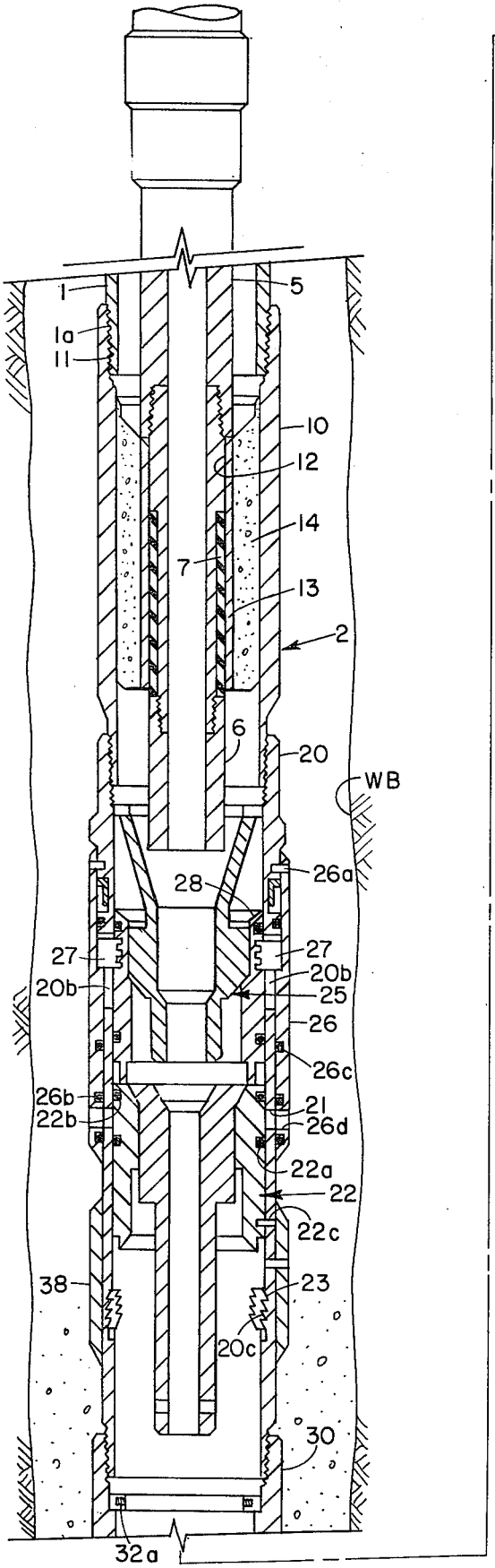
FIGS. 3A and 3B are respectively views similar to FIGS. 2A and 2B, but illustrating the end of the first stage cementing operation and the downward displacement of a wiper plug in the tubular housing to effect the sealing of the axial flow passage at the bottom end of the tubular housing.
Figure 3B:
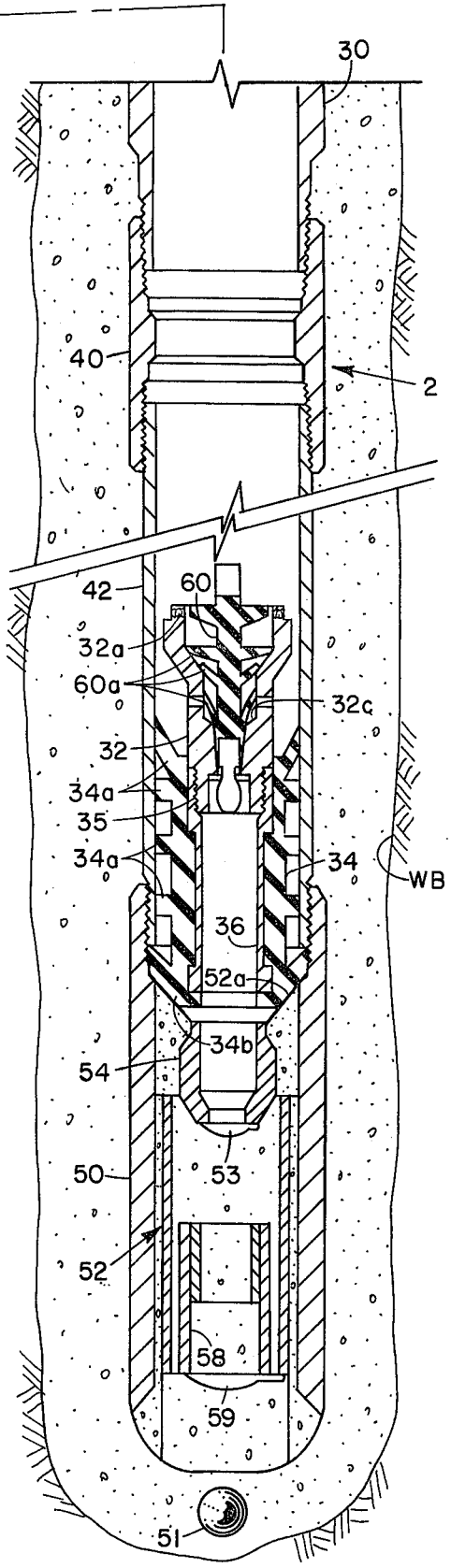

Following the insertion of the well casing 1 into the well with the tubular assembly 2 on the bottom end thereof as shown in FIGS. 1A and 1B, the cementing operation can be initiated. Referring now to FIGS. 2A and 2B, the bottom end 6 of a small diameter drill pipe 5 is inserted in the well and seal elements 7 conventionally mounted on the bottom end 6 are sealing engaged with the seal bore 12 defined in the first housing sleeve 10. Cementing fluid is then introduced through the drill pipe 5 and flows downwardly through the aligned axial passages defined by the annular valve units 25 and 22, through the annular passage defined by the wiper plug mounting 32 and through the float shoe 52. it being understood that the ball 51 has been expended through its seat and the catcher sleeve 56 through the application of sufficient pressure to cause the ball and flange 57 to pass axially out of end of the tubular assembly 2. The cement then flows downwardly to fill the bottom portions of the well bore WB and then upwardly around the exterior of the tubular housing tube to a level below the location of the radial cementing ports 21, as shown in FIGS. 3A and 3B. Thus the first stage of the cementing operation is completed.

A sealing plug 60 (FIG. 3B) having elastomeric flanges 60*a*is then forced through the drill pipe 5, effecting a wiping of the pipe, and is then forced downwardly through the axial bores of annular valves 25 and 22 to sealingly engage with an upwardly facing inclined annular surface 32*c* formed on the annular wiper plug mount 32. Once this sealing engagement has been accomplished, the fluid pressure within the bore of those portions of the tubular assembly 2 disposed above the sealing plug 60 can be substantially increased through pressurized fluid supplied through drill pipe 5. When the fluid pressure thus applied exceeds the strength of the shear screws 32*a*, the entire wiper plug assembly 34 will move downwardly to the position indicated in FIGS. 3B and effect a complete sealing of the axial cementing passage provided in the float shoe 52 through the cooperation of the downwardly facing annular elastomeric surface 34*b* formed on the bottom of elastomeric wiper plug 34 with the upwardly facing, annular sealing surface 52*a* formed on the top of the float shoe 52.

Figure 4A:
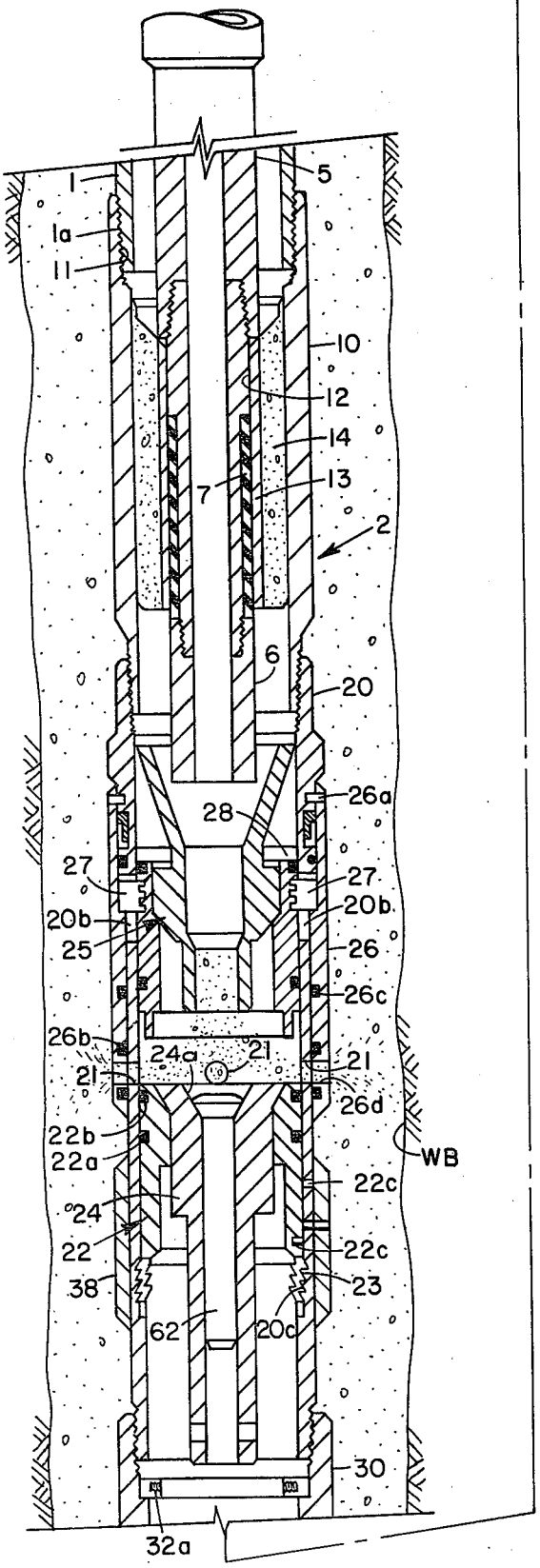
FIGS. 4A and 4B are respectively views similar to FIGS. 3A and 3B but illustrating the placement of a sealing plug in the first annular valve unit to effect the downward shifting of the first annular valve unit to open the radial cementing ports and the application of the second stage of cement.
Figure 4B:
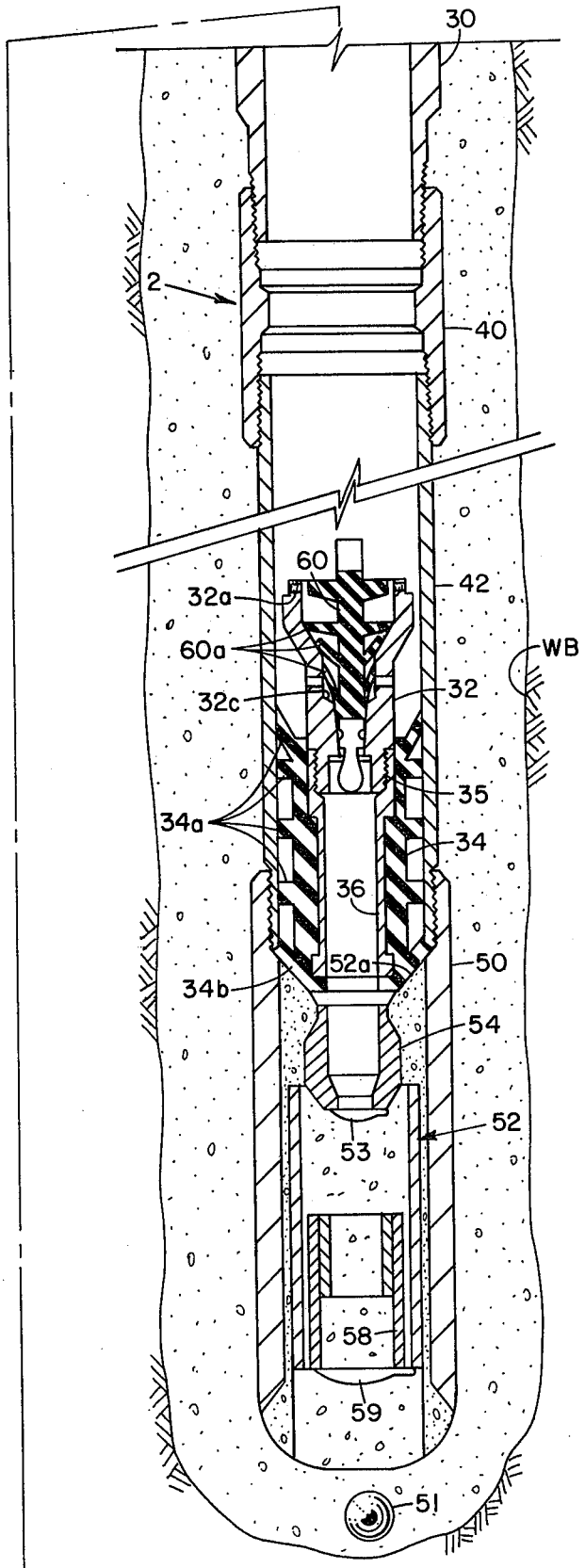

The apparatus is now ready for initiation of the second stage cementing operation. The first step in initiating the second stage cementing operation is the dropping of a sealing plug 62 (FIG. 4A) to sealingly engage an upwardly facing annular sealing surface 24*a* defined on an internal sleeve 24 carried by the first or lower annular valve 22. The plug 62 must be of smaller diameter than the bore of the second or upper annular valve unit 25 to permit its unimpeded passage through such valve unit. When the plug 62 is installed, pressured fluid may then be supplied through the drill pipe 5 to increase the pressure above the first or lower annular valve unit 22 to a level sufficient to effect the shearing of the shear pins 22*c*, whereupon the valve unit 22 will move downwardly to the position illustrated in FIG. 4A wherein the radial cement ports 21 are open to the bore of the tubular assembly 2.

The downward movement of the lower annular valve unit 22 in response to the applied fluid pressure is limited by an externally wicker threaded C-ring stop 23 which engages suitable wicker threads 20*c* provided on the interior of the housing sleeve element 20.

Cementing fluid may then be supplied through the drill pipe 5 which will flow through the bore of the upper annular valve unit 25 and thence radially outwardly to the exterior of the tubular assembly 2 through the radial cementing ports 21 and sleeve ports 26*d* (FIG. 4A), thus filling the annulus between the well bore WB and tubular assembly 2 with cement to a substantially higher level.

Figure 5A:
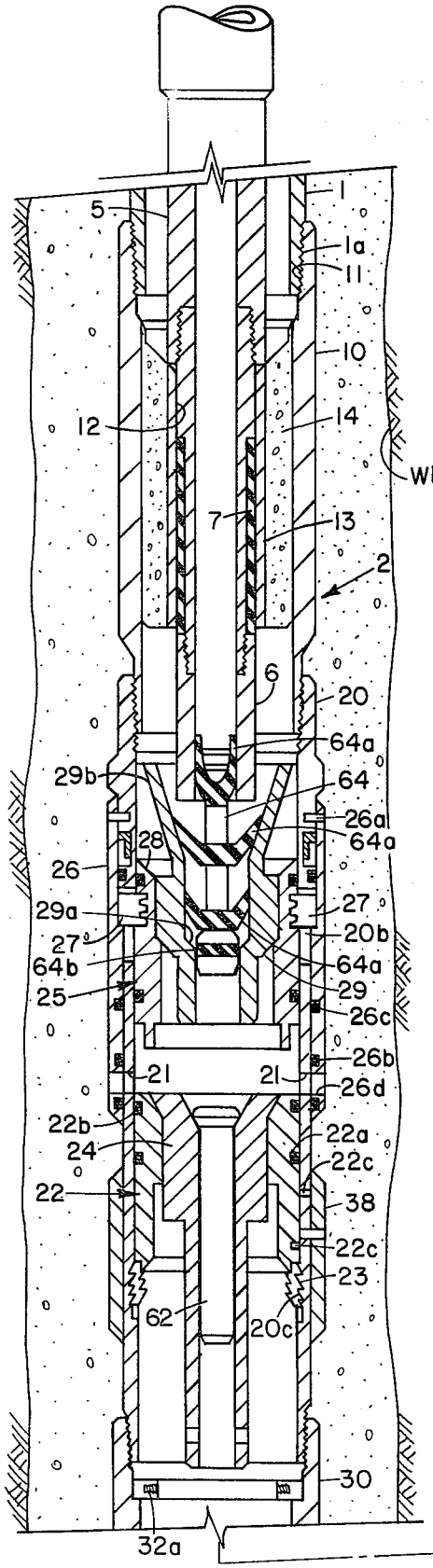
FIGS. 5A and 5B are respectively views similar to FIGS. 4A and 4B but illustrating the completion of the second stage cementing operation and the insertion of a wiper type sealing plug through the tubular member into engagement with the second annular valving unit.
Figure 5B:
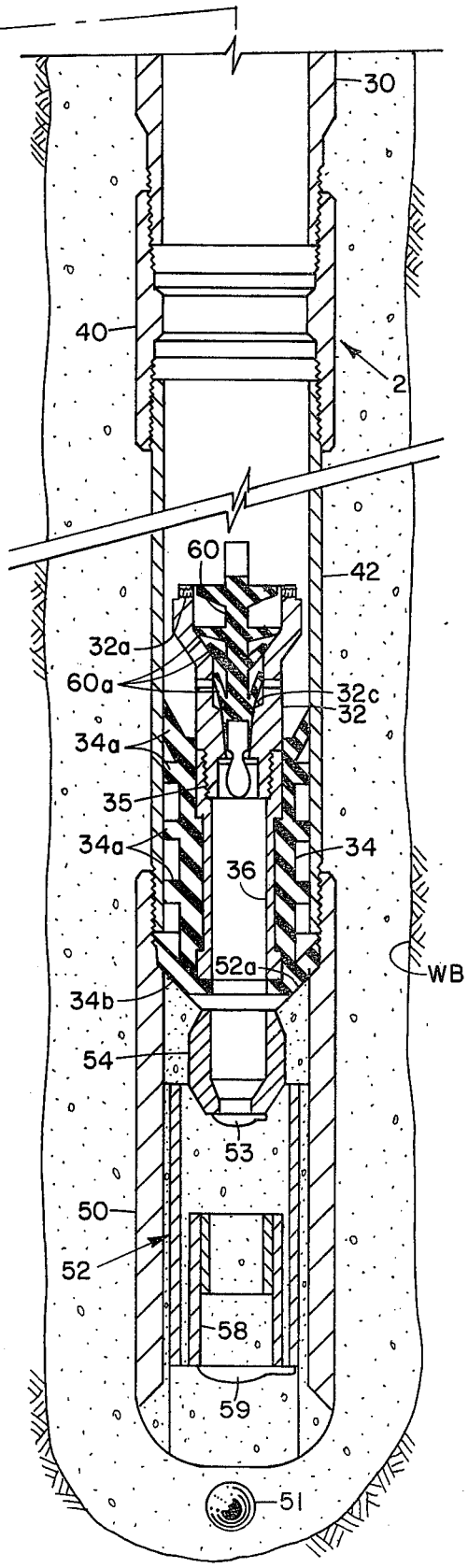
Figure 6A:
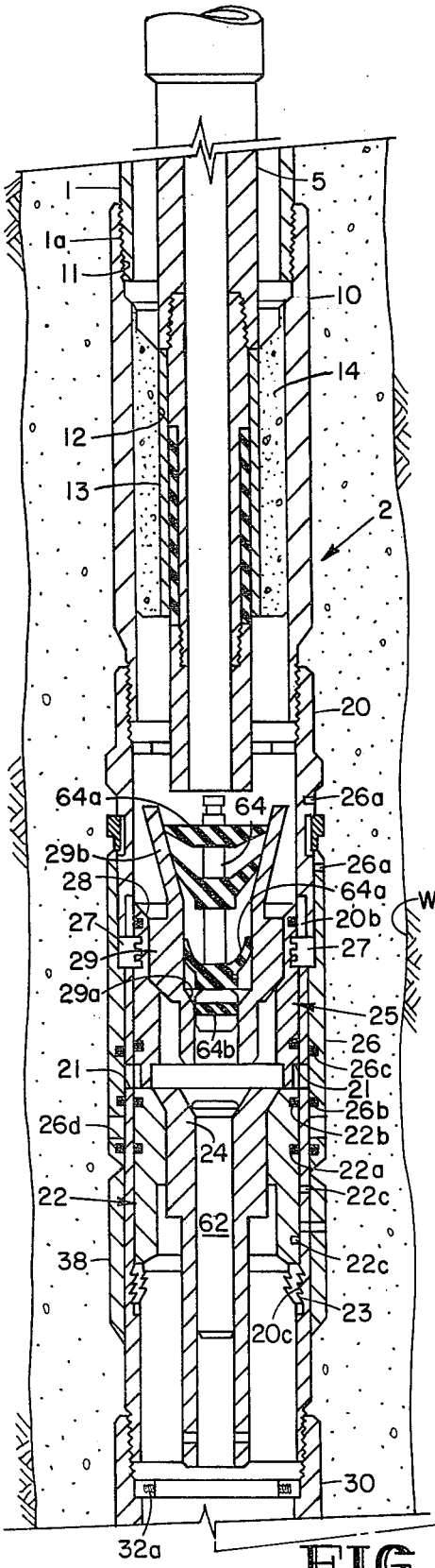
FIGS. 6A and 6B are respectively views similar to FIGS. 5A and 5B but illustrating the downward displacement of the second annular valve unit to effect the closing of the radial cementing ports.
Figure 6B:
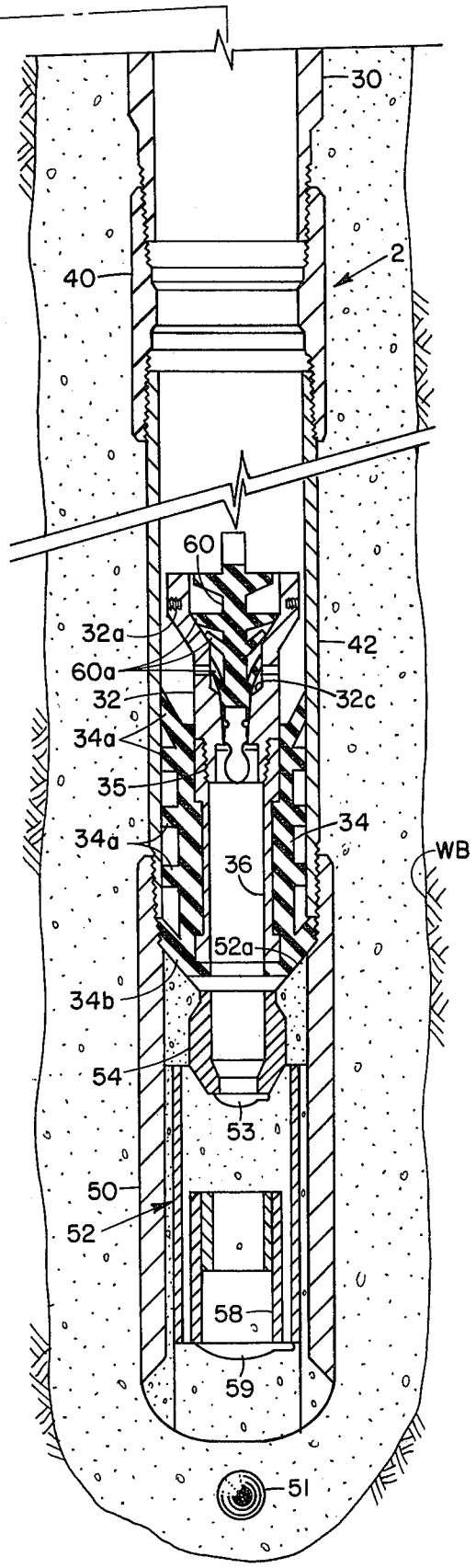

When the desired amount of cement has been supplied for the second stage operation, a combined wiping and sealing plug 64 (FIG. 5A) is then forced downwardly through the bore of the drill pipe 5, effecting the final wiping of such bore. The wiping and sealing plug 64 is provided with a plurality of axially spaced, elastomeric wiping discs 64*a* and an elastomeric sealing band 64*b* on its lower end which is shaped to engage an upwardly facing sealing surface 29*a* provided on an annular insert 29 which is mounted within the annular piston 28. Annular insert 29 is further provided with an outwardly flared upper portion 29*b* which effects a sealing engagement with a number of the elastomeric wiping discs 64*a*. Thus, the bore of the tubular assembly 2 is effectively sealed by the combination wiper and sealing plug 64. Supplying a pressured fluid through the drill pipe 5 will then permit the pressure acting on the upper annular valve unit 25 to be increased to a level sufficient to effect the shearing of the shear pins 26*a*. Upon such shearing, the annular piston 28 will move the outer sleeve valve 26 downwardly and position the annular seals 26*b* and 26*c* respectively on opposite sides of the radial cementing ports 21, thus sealing such ports (FIG. 6A).

To assure the accurate alignment of the outer sleeve 26 with respect to the radial cementing ports 21, a stop sleeve 38 is pinned to the exterior of the sleeve housing element 20.

The construction of the upper annular valve unit 25 may be substantially identical to that of the lower annular valve unit 22 so long as the bore defined by the upper annular unit is of greater diameter than that of the bore of the lower valve unit so as to permit the sealing plug 64 to be passed through the upper valve unit into sealing engagement with the bore of the lower valve unit. However, in many applications, it is desirable to drill out all of the internal apparatus provided within the bore of the tubular assembly 2 and, for this reason, the provision of the external valve sleeve 26 to effect the valve closing operation of the second annular valve unit 25 is desirable.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. A well conduit cementing apparatus for effecting plural stage cementing of a subterranean well conduit by cement supplied through a small diameter tubular member, comprising, in combination a tubular assembly attachable at its upper end to the well conduit; means in the upper end of the bore of said tubular assembly for sealingly engaging the bottom portion of the small diameter tubular member; means in the lower portions of the bore of said tubular assembly defining an axial cement conduit communicating with the well, whereby a first stage of cement may be supplied through the tubular member to exteriorly surround the lower portions of said tubular assembly; a plurality of peripherally spaced cement ports in said tubular assembly located above the first stage cement level; a first annular valve mounted relative to said tubular assembly in sealing relation to said cement ports; a first plug means movable through the tubular member to seal the bore of said first annular valve, whereby pressured fluid applied through the tubular member will urge said first annular valve to expose said radial cement ports, thereby permitting a second stage of cement to be supplied through the tubular member and said cement ports to the exterior of said tubular assembly; a second annular valve mounted relative to said tubular assembly above said first annular valve; an annular piston assembly mounted in said tubular assembly and operatively connected to said second annular valve; and a second plug means droppable through the tubular member to seal the bore of said annular piston assembly above said radial cement ports, thereby permitting pressured fluid supplied through the tubular member to urge said annular piston assembly and said second annular valve downwardly to close said cement ports.

2. A well conduit cementing apparatus for effecting plural stage cementing of a subterranean well conduit by cement supplied through a tubular member comprising, in combination; a tubular assembly attachable at its upper end to the well conduit; means in the upper end of the bore of said tubular assembly for sealingly engaging the bottom portion of a tubular member; means in the lower portions of the bore of said tubular assembly defining an axial cement conduit communicating with the well and a first upwardly facing, annular sealing surface surrounding the cement conduit; a first annular elastomeric wiper plug proportioned to wipe the lower bore surface of said tubular assembly, said first wiper plug having a bottom sealing surface seatable on said upwardly facing annular sealing surface; a mounting sub for said first wiping plug; first selectively disengageable means for securing said mounting sub in an elevated position relative to said first upwardly facing, annular sealing surface; said mounting sub defining a second upwardly facing annular sealing surface; a first valve element movable through the tubular member to seal on said second upwardly facing, annular sealing surface, whereby fluid pressure applied through the tubular member will urge said selectively disengageable means to disengaged position and force said first wiping plug downwardly to seal on said first upwardly facing, annular sealing surface in the bottom of the tubular assembly at the conclusion of the first cement stage; said tubular assembly further defining a plurality of cementing ports in its medial portion; a valve sleeve assembly mounted on said tubular assembly and normally blocking flow through said cementing ports; second selectively disengageable means initially securing said valve sleeve assembly in its said flow blocking position; a third upwardly facing annular sealing surface formed on said valve sleeve assembly; a second valve element movable through the tubular member to sealingly engage said third upwardly facing, annular sealing surface, whereby fluid pressure applied through the tubular member will effect the disengagement of the second selectively disengageable means and shift said valve sleeve assembly downwards to open said cementing ports and permit a second stage cement flow; a fourth upwardly facing, annular sealing surface mounted in said tubular assembly above said cementing ports; a third valve element movable through the tubular member to sealingly engage said fourth sealing surface, thereby permitting pressured fluid to be supplied through the tubular member to the region above said third valve element; and annular piston means responsive to said pressured fluid in said region for closing said cementing ports.

3. The well cementing apparatus of claim 2 wherein said annular piston means comprises an annular piston slidable in the bore of said tubular assembly and defining said fourth annular sealing surface on its upper face; a port closing sleeve slidably mounted on the exterior of said tubular assembly: third selectively disengageable means securing said port closing sleeve in an elevated position relative to said radial ports; said tubular assembly having at least one axially extending slot between said annular piston and said port closing sleeve; and at least one radial projection on said annular piston projecting through said axially extending slot in said tubular assembly to abuttingly engage said port closing sleeve, whereby the said increase in fluid pressure forces said annular piston downwardly to disengage said third selectively disengageable means and move said port closing sleeve downwardly to a closed position relative to said cementing ports.

4. The well cementing apparatus of claim 2 or 3 wherein said first valve element is of smaller diameter than said second sealing element and passable through said second and third upwardly facing, annular sealing surface, and said second valve element is of smaller diameter than said third valve element and passable through said fourth upwardly facing, annular sealing surface.

5. A drill pipe cementing stage apparatus for a well conduit comprising: a tubular assembly connectable to the bottom of a well conduit; means in an upper portion of said tubular assembly for sealingly mounting the bottom end of a drill pipe; a plurality of peripherally spaced radial cement ports in said tubular assembly below the drill pipe; a first annular valve unit mounted on said tubular assembly for axial sliding movement between an upper sealing position relative to said radial cement ports and a lower port opening position; selectively disengageable means for securing said first annular valve unit in said upper sealing position; means on said first annular valve unit for selectively sealing the bore of said tubular assembly, thereby permitting pressured fluid supplied through the drill pipe to exert a downward force on said first annular valve unit to disengage said selectively disengageable means and shift to said port opening position, whereby cement may flow from the drill pipe through said radial cement ports; a second annular valve unit mounted on the exterior of said tubular assembly for axial sliding movement between an upper nonsealing position relative to said radial cement ports and a lower sealing position; second selectively disengageable means for securing said second annular valve unit in said upper nonsealing position; a piston mounted within said tubular assembly and operatively connected to said second annular valve unit; and means on said piston for selectively sealing the bore of said tubular assembly above said radial ports, thereby permitting pressured fluid supplied through the drill pipe to exert a downward force on said piston to shear said second selectively disengageable means and shift said second annular valve unit to said port closing position.

* * * * *